US007329332B2

(12) United States Patent
Schussler

(10) Patent No.: US 7,329,332 B2
(45) Date of Patent: Feb. 12, 2008

(54) DIAPHRAGM FOR ELECTROLYTIC CELL

(75) Inventor: Henry W. Schussler, Harrison City, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 370 days.

(21) Appl. No.: 11/184,967

(22) Filed: Jul. 20, 2005

(65) Prior Publication Data

US 2006/0042936 A1 Mar. 2, 2006

Related U.S. Application Data

(60) Provisional application No. 60/604,377, filed on Aug. 25, 2004.

(51) Int. Cl.
*C25B 11/03* (2006.01)

(52) U.S. Cl. ..... 204/283; 204/252; 204/263; 204/266; 204/296; 205/350; 205/687; 427/243; 427/244; 427/245; 427/247

(58) Field of Classification Search ..... 204/283, 204/252, 263, 266, 296; 205/350, 687; 427/243, 427/244, 245, 247
See application file for complete search history.

(56) References Cited

U.S. PATENT DOCUMENTS

| | | | |
|---|---|---|---|
| 3,385,915 | A | 5/1968 | Hamling |
| 4,036,729 | A | 7/1977 | Patil et al. |
| 4,126,535 | A | 11/1978 | Balko et al. |
| 4,165,271 | A | 8/1979 | Kadija |
| 4,169,774 | A | 10/1979 | Kadija et al. |
| 4,184,939 | A | 1/1980 | Kadija |
| 4,311,566 | A | 1/1982 | McCann |
| 4,315,062 | A | 2/1982 | Clarizio |
| 4,409,085 | A | 10/1983 | Kadija et al. |
| 4,417,959 | A | 11/1983 | Kadija et al. |
| 4,437,951 | A | 3/1984 | Bissot et al. |
| 4,517,064 | A | 5/1985 | Cook |
| 4,559,124 | A | 12/1985 | Divisek et al. |
| 4,666,573 | A | 5/1987 | DuBois et al. |
| 4,680,101 | A | 7/1987 | Darlington et al. |
| 4,720,334 | A | 1/1988 | DuBois et al. |
| 4,869,793 | A | 9/1989 | Kinney |
| 5,030,403 | A | 7/1991 | Pickens et al. |
| 5,188,712 | A | 2/1993 | Dilmore et al. |
| 5,192,401 | A | 3/1993 | DuBois et al. |
| 5,288,712 | A | 2/1994 | Chen |
| 5,470,449 | A | 11/1995 | Bachot et al. |
| 5,567,298 | A | 10/1996 | DuBois et al. |
| 5,584,977 | A | 12/1996 | Bachot et al. |
| 5,612,089 | A | 3/1997 | Dilmore, Jr. et al. |
| 5,630,930 | A | 5/1997 | Maloney |
| 5,683,749 | A | 11/1997 | DuBois et al. |
| 5,720,933 | A | 2/1998 | Srinivasan |
| 5,780,154 | A | 7/1998 | Okano et al. |
| 5,919,348 | A | 7/1999 | Friedrich et al. |
| 6,059,944 | A | 5/2000 | DuBois et al. |
| 6,296,745 | B1 | 10/2001 | DuBois et al. |
| 6,299,939 | B1 | 10/2001 | DuBois et al. |
| 6,352,660 | B1 | 3/2002 | Friedrich et al. |
| 6,395,080 | B1 | 5/2002 | Cass et al. |
| 2005/0164025 | A1* | 7/2005 | Simonetti et al. ..... 428/532 |
| 2007/0163890 | A1* | 7/2007 | Schussler ..... 205/687 |

FOREIGN PATENT DOCUMENTS

| | | |
|---|---|---|
| EP | 0 196 317 | 3/1990 |
| EP | 1 029 118 B1 | 8/2001 |
| EP | 0 865 517 B1 | 7/2002 |

OTHER PUBLICATIONS

U.S. Appl. No. 11/216,492, entitled "Method of Operating A Diaphragm Electrolytic Cell," filed on Aug. 31, 2005.
U.S. Appl. No. 11/334,907, entitled "Diaphragm For Electrolytic Cell," filed on Jan. 19, 2006.

* cited by examiner

*Primary Examiner*—Bruce F. Bell
(74) *Attorney, Agent, or Firm*—Linda Pingitore

(57) ABSTRACT

Describes a cathode assembly for electrolytic cells, e.g., chlor-alkali electrolytic cells, comprising a foraminous cathode substrate, a deposited erodible mat comprising synthetic (man-made) fibers, e.g., polyamide (nylon) fibers, on the foraminous surface of said cathode substrate, and a synthetic diaphragm on said erodible mat. Also described is a method for preparing the cathode assembly that comprises depositing a mat of erodible synthetic fibers on the active surface of the foraminous cathode, e.g., by drawing an aqueous slurry of the erodible synthetic fibers through the foraminous cathode, and subsequently forming, e.g., by vacuum deposition, a synthetic diaphragm on the erodible mat.

24 Claims, No Drawings

DIAPHRAGM FOR ELECTROLYTIC CELL

CROSS-REFERENCE TO RELATED APPLICATIONS

This application is related to Provisional Patent Application Ser. No. 60/604,377 filed Aug. 25, 2004.

FIELD OF THE INVENTION

The present invention relates to improved methods for forming a liquid-permeable (microporous) synthetic (non-asbestos) diaphragm on a foraminous cathode, and to the resulting composite cathode-diaphragm structure. In particular, the present invention relates to methods for preparing a liquid-permeable synthetic diaphragm for electrolytic cells, e.g., electrolytic cells used to electrolytically convert alkali metal halide to alkali metal hydroxide and halogen, and the synthetic diaphragms prepared by such methods.

BACKGROUND OF THE INVENTION

The electrolysis of aqueous alkali metal halide brines, such as sodium chloride and potassium chloride brines, in an electrolytic cell is a well-known commercial process. Electrolysis of such brines results in the production of products and by-products, that include halogen, hydrogen and alkali metal hydroxide. In the case of sodium chloride brines, the halogen produced is chlorine and the alkali metal hydroxide is sodium hydroxide. The electrolytic cell typically comprises an anolyte compartment containing an anode, and a catholyte compartment containing a cathode assembly. The cathode assembly typically comprises a metallic foraminous cathode and a liquid-permeable (microporous) diaphragm, which diaphragm separates the electrolytic cell into the anolyte and catholyte compartments.

Electrolysis of alkali metal halide brines typically involves charging an aqueous solution of the alkali metal halide salt, e.g., sodium chloride brine, to the anolyte compartment of the cell. The alkali metal halide brine typically contains alkali metal halide, e.g., sodium chloride, in an amount of from 24 to 26 percent by weight. The aqueous brine percolates through the liquid-permeable diaphragm into the catholyte compartment and then is withdrawn from the cell. With the application of direct electric current to the cell, electrolysis of a portion of the alkali metal halide within the cell occurs, and halogen gas, e.g., chlorine, is produced at the anode, while hydrogen gas is produced at the cathode. An aqueous solution of alkali metal hydroxide, e.g., sodium hydroxide, is produced in the catholyte compartment from the combination of alkali metal ions with hydroxyl ions and is withdrawn from the catholyte compartment with the depleted alkali metal halide brine from which the alkali metal hydroxide is subsequently separated.

Historically, asbestos was the most common diaphragm material used in diaphragm cells for the electrolysis of alkali metal brines because of its chemical resistance to the corrosive conditions that exist in such diaphragm cells. Such electrolytic cells have been referred to as chlor-alkali electrolytic diaphragm cells or just chlor-alkali cells. Asbestos in combination with various polymeric resins, particularly fluorocarbon resins (the so-called polymer or resin modified asbestos diaphragms), have been used also as diaphragm materials in such electrolytic cells.

Due in part to possible health and safety issues associated with air-borne asbestos fibers resulting from the use of asbestos in other applications, diaphragms that are substantially free of asbestos, e.g., non-asbestos-containing diaphragms, have been developed recently for use in chlor-alkali diaphragm electrolytic cells. Diaphragms that are substantially free of asbestos, e.g., non-asbestos-containing diaphragms, are often referred to in the art as synthetic diaphragms. Synthetic diaphragms are typically fabricated from fibrous polymeric materials that are resistant to the internal corrosive conditions present in the operating chlor-alkali cell, particularly the corrosive environments found in the anolyte and catholyte compartments.

Typically, microporous (liquid-permeable) diaphragms are formed on the cathode structure by vacuum depositing (in one or more steps) the diaphragm onto the foraminous cathode substrate from aqueous slurries of materials comprising the diaphragm. In the beginning of this depositing process, there is an initial loss of diaphragm materials, e.g., fibrous polymeric materials, that occurs until an inhibiting layer of fibrous diaphragm material forms on the cathode, thereby inhibiting the further passage of solids dispersed in the slurry containing the diaphragm materials through the porous cathode. When the diaphragm is a synthetic diaphragm, this initial loss of diaphragm materials can be costly due to the higher cost of fibrous perhalogenated polymer and halogenated cation exchange polymer materials that typically comprise the synthetic diaphragm, as compared to the cost of asbestos. Further, it is not always possible to re-use the solid diaphragm materials that pass through the porous cathode, which material is referred to as diaphragm slurry filtrate, during the initial formation of the inhibiting layer of the diaphragm. The diaphragm slurry filtrate typically comprises very fine fibers that can blind a foraminous cathode quickly (if used again) and prevent the formation of a diaphragm having the thickness needed to achieve commercially acceptable cell efficiencies. Moreover materials, such as cellulose thickening agents that are present in the diaphragm slurry filtrate are susceptible to being consumed by bacteria found in the slurry.

In order to reduce the initial loss of synthetic diaphragm solid materials during vacuum deposition of the diaphragm, e.g., the inhibiting layer, a preformed nylon net has been placed over the cathode structure before beginning vacuum deposition of the diaphragm. However, it has been found that the fabrication of such a net and its attachment to the foraminous cathode is both time-consuming and expensive, particularly in the case of fingered cathodes. For example, the nylon net is typically cut and sewn into sleeves that are open on one long side. The sleeves can be sewn so as to cover from one to six cathode fingers. Further, each sleeve unit contains additional fabric for the valleys between the fingers of adjacent sleeve units. The sleeves are placed over the cathode fingers with fabric overlapping in the valleys. The periphery of the sleeves is typically attached to the cathode with a glue adhesive.

It has been observed that when a vacuum is applied to the foraminous cathode having a preformed nylon net applied to it during the deposition process, the strands of nylon covering the holes in the cathode can shift and deform, as the nylon can be stretched in one direction, thereby exposing a larger section of the holes in the foraminous cathode than is desirable, which permits the slurry of diaphragm materials to flow more readily through those exposed holes, thereby defeating the purpose of using the nylon net as a partial barrier to prevent excessive loss of diaphragm solids. Further, it has been observed that thin layers of diaphragm material are formed at locations on the cathode structure where the nylon net overlaps or is creased, and diaphragm solids are deposited between the nylon folds. When the nylon disintegrates during cell operation, larger openings are formed in the diaphragm, which openings act as a convenient path for the anolyte to pass through more easily, which in turn causes a reduction in cell efficiency and a possible shortening of diaphragm life.

BRIEF SUMMARY OF THE INVENTION

In one non-limiting embodiment, there is provided a cathode assembly for an electrolytic cell comprising a foraminous cathode substrate, a deposited liquid-permeable erodible mat comprising synthetic fibers on a surface of the cathode substrate, and a synthetic diaphragm on said synthetic fiber-containing erodible mat. In another non-limiting embodiment, there is provided a method of preparing a cathode assembly for use in an electrolytic cell comprising depositing a mat of synthetic erodible fibers on a foraminous cathode, and forming a synthetic diaphragm on said mat.

DETAILED DESCRIPTION OF THE INVENTION

For purposes of this specification (other than in the operating examples), unless otherwise indicated, all numbers expressing quantities and ranges of ingredients, process conditions, etc are to be understood as modified in all instances by the term "about". Accordingly, unless indicated to the contrary, the numerical parameters set forth in this specification and attached claims are approximations that can vary depending upon the desired results sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Further, as used in this specification and the appended claims, the singular forms "a", "an" and "the" are intended to include plural referents, unless expressly and unequivocally limited to one referent.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Also, it should be understood that any numerical range recited herein is intended to include all sub-ranges subsumed therein. For example, a range of "1 to 10" is intended to include all sub-ranges between and including the recited minimum value of 1 and the recited maximum value of 10, that is having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

As used in the following description and claims, the following terms have the indicated meanings:

The term "deposited" or some other equivalent term, as used in connection with the liquid-permeable erodible mat of synthetic fibers, means that the fibers of the erodible synthetic material comprising the mat are laid down on the foraminous cathode so that the mat is formed in-situ, and is not pre-formed and then laid over the cathode.

The term "electrolytic cell", as used herein, means any type of cell wherein an electrolyte is passed through an electrical field generated between an anode and a cathode to dissociate the electrolyte and synthesize chemicals. For example, chlorates, perchlorates, halogen, hydroxides, dithionites, carbonates and the like can be manufactured in and recovered from such cells. One non-limiting embodiment of an electrolytic cell is a chlor-alkali electrolytic cell wherein, for example, sodium chloride brine is electrolyzed to produce sodium hydroxide and chlorine.

The term "erodible", as used for example in connection with the synthetic fibers used to prepare the liquid-permeable mat, means that during operation of the electrolytic cell, the fibers of the mat degrade or erode as a consequence of being exposed to the corrosive chemical or physical conditions that exist within the cell.

The terms "on", "appended to", "affixed to", "adhered to" or terms of like import means that the referenced material is either directly connected to (superimposed on) the described surface, or indirectly connected to the object surface through one or more other layers (superposed on).

The term "synthetic diaphragm" means a liquid-permeable diaphragm that is substantially free of asbestos (non-asbestos-containing diaphragms), i.e., a synthetic diaphragm that contains not more than 5 weight percent of asbestos. In alternate non-limiting embodiments of synthetic diaphragms, the diaphragm contains not more than 3, e.g., not more than 2 or 1, weight percent of asbestos. In a further alternate embodiment, the synthetic diaphragm is totally free of asbestos.

The term "synthetic fiber", as used in connection with the fibers used to prepare the liquid-permeable mat, means organic fibers that are man-made (as opposed to naturally occurring fibers), e.g., fibers of materials that have been chemically synthesized, or fibers of materials that have been chemically treated in a manner that substantially changes the chemical nature of the original starting material during such chemical treatment, as contrasted with only physical changes of a material resulting from mechanical operations, e.g., shredding, grinding, size classification, etc.

In accordance with a non-limiting embodiment of the present invention, there is provided a cathode assembly for an electrolytic cell comprising a foraminous cathode substrate, a deposited liquid-permeable erodible mat comprising synthetic fibers on a surface of said cathode substrate, and a liquid-permeable synthetic diaphragm on said synthetic fiber-containing erodible mat.

In accordance with a further non-limiting embodiment of the present invention, there is provided a cathode assembly for a chlor-alkali electrolytic cell comprising a foraminous metallic cathode substrate, a vacuum deposited liquid-permeable erodible mat comprising aliphatic polyamide (nylon) fibers appended to an electrolytically active portion of the foraminous surface of said cathode substrate, and a liquid-permeable synthetic non-asbestos-containing diaphragm appended to said erodible mat.

In accordance with a still further embodiment of the present invention, there is provided a method of preparing a cathode assembly for use in an electrolytic cell comprising (a) drawing a slurry comprising synthetic erodible fibers through a foraminous cathode, thereby to deposit a mat comprising said fibers on at least a portion of the foraminous surface of the cathode, and subsequently forming a liquid-permeable synthetic diaphragm on said erodible mat.

The above-described cathode assembly comprising a foraminous cathode, deposited liquid-permeable erodible mat comprising synthetic fibers and liquid-permeable synthetic diaphragm can be used in diaphragm electrolytic cells wherein a chosen electrolyte is passed through an electrical field generated between an anode and cathode of the electrolytic cell to dissociate the electrolyte, e.g., a chlor-alkali diaphragm electrolytic cell.

A variety of electrolytic cells (electrolyzers) can be used for the electrolysis of alkali metal brines. These electrolyzers are described in the art and include monopolar and bipolar cells that contain planar and non-planar electrodes. Typically, each cell housing comprises a plurality of individual cell units wherein a succession of anode units alternate with cathode assemblies. One non-limiting example is a bipolar electrolyzer wherein substantially vertical cathodes are interleaved or positioned within and spaced from substantially vertical anodes. This type of electrode assembly has been referred to as a fingered configuration, e.g., wherein a series of cathode fingers and anode fingers are interleaved with one another.

The cathode is a liquid-permeable, microporous substrate, e.g., a foraminous metal cathode. The cathode is electroconductive and can be a perforated sheet, a perforated plate, metal mesh, expanded metal mesh, woven screen, an arrangement of metal rods or the like having equivalent openings (nominal diameter) typically in the range of from 0.05 inch (0.13 cm) to 0.125 inch (0.32 cm), more typically in the range of from 0.07 inch (0.17 cm) to 0.1 inch (0.25 cm). The cathode is typically fabricated of iron, iron alloy or some other metal, such as nickel, that is resistant to the electrolytic cell environment to which the cathode is exposed, e.g., the corrosive environment of an operating chlor-alkali electrolytic cell.

The synthetic (man-made) fibrous material used to prepare the thin mat can be chosen from a variety of man-made fibers. Non-limiting examples of such fibrous materials are aliphatic polyamide fibers, aromatic polyamide fibers, acrylic fibers, rayon fibers, acetate fibers, triacetate fibers, polyolefin fibers, polyester fibers and polyphenylene sulfide fibers. The fibers comprising the synthetic mat are erodible under the conditions of electrolytic cell operation. As a result, the mat is removed gradually during operation of the electrolytic cell, leaving a cathode assembly comprising the metallic cathode and the synthetic diaphragm, e.g., a cathode assembly devoid of the base mat.

The fibers comprising the synthetic base mat are generally materials that are commercially available. If fibers of such materials are not commercially available or are not available in the size desired, such fibers can be prepared by methods known to those skilled in the art of fiber preparation. If fibers of a certain size, e.g., length, are not available, larger fibers can be reduced in size by subjecting them to high shear or attrition by methods known to those skilled in the art.

The fibers comprising the synthetic base mat can vary in cross-section and profile, but are typically round since conventional spinneret orifices are circular. The degree of fineness, e.g., thickness, of these fibers can vary broadly and is commonly expressed by the term "denier". The fibers comprising the synthetic base mat will typically be from 1 to 50 denier, e.g., from 1.8 to 30 denier, more typically from 20 to 30, e.g., 15, denier. The fibers can have a length of from 1 to 15, e.g., 12.7, millimeters, typically from 2 to 8 millimeters, more typically from 3 to 6.5 millimeters, e.g., 3 millimeters.

In accordance with a non-limiting embodiment of the present invention, the fibers of the erodible synthetic base mat material are superposed, e.g., superimposed, on the foraminous cathode. By "superposed" is meant herein that the mat is formed, e.g., deposited, on the foraminous cathode whether or not in direct contact with the surface of the cathode. Thus it is possible for one or more further layers of other materials to be between the surface of the cathode and the base mat. By "superimposed" is meant herein that the erodible mat is formed, e.g., deposited, on the surface of the foraminous cathode and is in contact with the cathode surface.

In accordance with a non-limiting embodiment of the method of the present invention, the liquid-permeable, erodible fibrous mat is formed in-situ on at least a portion of the electrolytically active section of the foraminous cathode (whether directly in contact with the electrolytically active surface of the cathode or in contact with another layer of material(s) that is in contact with that surface of the cathode). The mat can be formed in-situ by any means known to those skilled in the art, e.g., by spraying, vacuum forming, etc. In one non-limiting embodiment, the mat is laid down over the cathode substrate by vacuum deposition from a slurry, e.g., an aqueous slurry, of the materials comprising the mat, e.g., by placing the portion of the foraminous cathode surface to be covered within a slurry of the materials comprising the mat, and pulling the slurry through the foraminous cathode with the assistance of negative pressure, e.g., a vacuum, applied to the cathode, thereby depositing or laying down a thin layer of the materials, e.g., the fibrous materials, comprising the mat over the foraminous surface of the cathode.

A non-limiting example of synthetic (man-made) erodible fibers that are used to form the liquid-permeable thin mat is polyamide or nylon fibers. As used herein, the term nylon is used synonymously with polyamide. The term "nylon" is a generic term known by those skilled in the art (and adopted by the U.S. Federal Trade Commission for designating fibers of the polyamide type) for any long chain synthetic polymeric amide, which has recurring amide groups (—CONH—) as an integral part of the main polymer chain, and which is capable of being formed into a filament in which the structural elements are oriented in the direction of the axis. See, for example, Encyclopedia of Polymer Science and Technology, Volume 1, pp 846-848, and Volume 10, pp 347-349, Interscience Publishers, a division of John Wiley & Sons, New York, 1969.

Polyamides are generally prepared either by the polycondensation of dicarboxylic acids with diamines or by the self-condensation of aminocarboxylic acids or the corresponding lactams. Non-limiting examples of aliphatic polyamides that can be used in accordance with the present invention include nylon 6-6 [CAS 9011-55-6], which is the polyamide obtained from the condensation of hexamethylenediamine with adipic acid; nylon 6-10, which is the polyamide obtained from the condensation of hexamethylenediamine with sebacic acid; nylon 6 [CAS 25038-54-4], which is obtained from the self-condensation of epsilon caprolactam; and nylon 11, which is obtained from the self-condensation of 11-amino undecanoic acid. It is also contemplated that mixtures of aliphatic polyamide fibers can be used. Non-limiting examples of aromatic polyamides include those based on isophthalic acid and m-phenylene diamine, e.g., NOMEX® and KEVLAR® fibers.

Non-limiting examples of other synthetic (man-made) fibers are acetate fibers [CAS 9004-35-7]; triacetate fibers [CAS 9012-09-3]; acrylic fibers such as those based on polyacrylonitrile; polyolefin fibers such as those polymers based on ethylenically unsaturated hydrocarbons containing from 2 to 4 carbon atoms, e.g., polyethylene such as low pressure polyethylene [CAS 9002-88-4] and high pressure polyethylene, and polypropylene [CAS 9003-07-0]; rayon fibers; polyester fibers, such as those based on a dihydric alcohol, e.g., ethylene glycol, and an aromatic dicarboxylic acid, such as terephthalic acid [CAS 25038-59-9]or dimethyl terephthalate, e.g., polyethylene terephthalate; and polyphenylene sulfide fibers. It is contemplated that mixtures of synthetic fibers can be used to form the deposited erodible mat of synthetic fibers. For example, mixtures of polyethylene and polypropylene fibers can be used, as well as mixtures of polyolefin and polyamide fibers, e.g., aliphatic polyamide and/or aromatic polyamide fibers.

For purposes of convenience, the following disclosure is directed specifically to a nylon (polyamide) mat, but as one skilled in the art appreciates, such specific disclosure is also applicable to mats formed from the other described synthetic man-made fibers used to prepare the erodible synthetic base mat.

The fibrous liquid-permeable erodible polyamide mat applied to, e.g., appended to, the foraminous cathode can be deposited, e.g., superposed, onto the cathode by, for example, vacuum deposition from a slurry comprising the fibrous polyamide, e.g., an aqueous slurry of polyamide fibers. The slurry of polyamide fibers typically contains from 0.01 to 10 weight percent of polyamide fibers, e.g., from 0.1 to 3 weight percent, more typically 0.25 weight percent, of the fibers. In addition to the dispersing medium, e.g., water, which can represent from 85 to 99 percent, e.g., 97 to 98.5 percent of the aqueous slurry, the slurry can contain small amounts of other additives, including, but not limited to, surfactants, alkaline reagent, e.g., sodium hydroxide, antifoaming compounds, antimicrobial compounds, e.g., biocides, and thickening agents. The aqueous slurry of polyamide fibers will typically be substantially free of asbestos material.

Polyamide fibers used to form the synthetic base mat will typically vary from 1 to 50 denier, e.g., from 1.8 to 30 denier, more typically from 10 to 20 denier, such as 15 denier. The fiber length can also vary, but typically will range from 1 to 12.7 millimeters (mm), e.g., from 2 to 8 mm, more typically from 3 to 6.5 mm.

The polyamide barrier mat deposited on the cathode, e.g., on the surface of the cathode, can vary in thickness. In alternate non-limiting embodiments, the thickness may vary from 0.1 to 3.3 millimeters (mm), typically from 0.14 to 1.2 millimeters. The basis weight of the polyamide mat can vary. In alternate non-limiting embodiments, the basis weight can vary from 2 to 40 ounces/square yard (0.068 to 1.36 kg/m$^2$), e.g., from 3 to 9 ounces/square yard (0.102 to 0.305 kg/m$^2$). The basis weight of the polyamide mat is the dried weight of the mat divided by the active area of the cathode, e.g., the area of the metal mesh or woven screen of the cathode.

A surfactant can be used to prepare the aqueous slurry of polyamide fibers. Although the selection of surfactants can vary, the surfactant is commonly an organic surfactant. In alternate non-limiting embodiments, the surfactant may be present in the slurry in amounts of at least 0.01 percent by weight, at least 0.02 percent by weight, or at least 0.05 weight percent, based on the weight of the water comprising the slurry. The organic surfactant, in alternate non-limiting embodiments, can be present in amounts of less than 1 weight percent, less than 0.5 weight percent, or less than 0.3 weight percent, e.g., less than 0.1 weight percent. The amount of organic surfactant present in the aqueous medium of the slurry can range between any combination of any of these values, inclusive of the recited values, e.g., between 0.05 and 0.15 weight percent.

The organic surfactant can be chosen from a variety of materials including ionic surfactants, non-ionic surfactants, amphoteric surfactants and mixtures of such surfactant materials. Non-limiting examples of such organic surfactants can be found in column 6, line 56 through column 8, line 44 of U.S. Pat. No. 6,059,944, which disclosure is incorporated herein by reference. Typically, the organic surfactant is a non-ionic surfactant, such as chloride capped ethoxylated aliphatic alcohols, wherein the hydrophobic portion of the surfactant is a hydrocarbon group containing from 8 to 15, e.g., from 12 to 15, carbon atoms, and the average number of ethoxylate groups ranges from 5 to 15, e.g., 9 to 10. Examples of such non-ionic surfactants are the AVANEL® N surfactants. Other surfactants such as ANTAROX® non-ionic surfactants can also be used.

Viscosity modifiers or thickening agents can be used in the aqueous polyamide fiber slurry to assist in the dispersion and application of the polyamide fibers. For example, thickening agents such as CELLOSIZE® materials can be used. Typically, from 0.1 to 5 percent by weight, based on the weight of the water used for the slurry, of thickening agent is used. More typically from 0.2 to 2 weight percent, e.g., from 0.4 to 0.8 weight percent, of thickening agent is used Antifoaming agents, such as UCON® antifoaming agents, e.g., UCON® 500, are typically used in the aqueous polyamide fiber slurry to reduce excessive foaming, if any, resulting from agitation of the aqueous slurry during its preparation. The antifoaming agent is used in antifoaming amounts, e.g., an amount that is sufficient to reduce (or eliminate) the level of foaming to a level acceptable to the operator. In one non-limiting embodiment, the antifoaming agent is used in amounts of from 0.005 to 0.1 weight percent, based on the weight of the water used for the slurry. Further, antimicrobial reagents can be added to the aqueous slurry to prevent the consumption (digestion) of microbe-susceptible components, e.g., cellulose thickening agents, in the slurry. A common antimicrobial that can be used is UCARCIDE® 250, which is available from the Dow Chemical Company. Any of the other microbial agents known to those skilled in the art can be used. Antimicrobial agents can be used in varying amounts. In alternate non-limiting embodiments, antimicrobials can be incorporated into the aqueous polyamide slurry in amounts between 0.05 and 0.5 percent by weight, between 0.07 and 0.2 weight percent, or between 0.08 and 0.1 weight percent, based on the weight of the water used for the slurry.

In accordance with a non-limiting embodiment of the method of the present invention, a slurry, e.g., an aqueous slurry, comprising polyamide (nylon) fibers is prepared by adding the components of the slurry, e.g., water, thickener, alkaline reagent, surfactant (if used), nylon fibers, antifoaming agent, antimicrobial agent, etc to a large tank, e.g., the deposition tank, and agitating the components, e.g., by air sparging or by mechanical mixing using a high shear, rotor/stator-type mixer, or an impellor-based mixer, until a substantially uniform slurry is formed. The mixing time and the degree of agitation is chosen to accomplish the desired dispersion while preventing size degradation of the fibers, as is known to those skilled in the art. The viscosity of the polyamide slurry is typically adjusted to within the range of 50 to 2000 centipoises (cp), e.g., 75 to 1000 cp, more typically from 500 to 800 cp, as measured on a Brookfield Model LFT viscometer using a #2 spindle at 30 rpm, to allow deposition on the surface of the cathode and in the orientation of choice, e.g., horizontally or vertically.

The foraminous cathode is placed within the slurry, which is contained in the deposition tank, and a vacuum applied to the cathode, thereby to cause the polyamide slurry to be drawn through the cathode, which results in polyamide fibers being deposited on the cathode, e.g., on the side of the cathode that will face the anode in the electrolytic cell.

Polyamide slurry is drawn through the cathode until the desired thickness of polyamide mat is obtained, or until the amount of polyamide being deposited on the cathode becomes de-minimus. If needed, the polyamide slurry can be mixed during the mat deposition process to insure that the slurry does not separate, e.g., remains uniform and homogeneous. The cathode containing the deposited nylon mat is generally removed from the slurry while the vacuum is maintained on the cathode in order to dewater the nylon mat. Alternatively, the slurry is drained from the tank, and the cathode is retained in the empty tank (while maintaining vacuum on the cathode) in order to dewater the nylon mat. Once the mat is sufficiently dewatered to maintain the integrity of the mat, the vacuum on the cathode can be broken, if desired.

In an alternate non-limiting embodiment of the deposition process, the cathode on which the nylon mat is deposited is withdrawn slowly from the slurry during the deposition process, e.g., when the cathode is placed vertically within the deposition tank, to allow gradual dewatering of the cathode. In a further non-limiting embodiment, the slurry within the deposition tank can be gradually lowered, e.g., by pumping out the slurry, during the deposition process. For example, the slurry can be gradually lowered concurrently with the gradual withdrawal of the cathode during vacuum deposition of the nylon mat. The rate at which the slurry is lowered within the deposition tank is typically matched approximately with the rate at which the cathode is withdrawn from the deposition slurry so as to avoid having the internal positive liquid head (pressure) within the cathode greater than the internal vacuum within the cathode, thereby substantially preventing the positive liquid head within the cathode from pushing the deposited nylon mat off of the surface of the cathode.

The level of vacuum used to deposit the nylon mat onto the foraminous cathode can vary widely. Generally, the vacuum used is that negative pressure that is sufficient to draw the polyamide slurry through the cathode until the desired thickness of the mat is obtained, and subsequently hold the mat against the cathode surface until the mat is dewatered. Vacuum pressures will typically vary from 12 to 500 mm of mercury. As deposition of the nylon mat proceeds and the mat thickens, it is customary to gradually increase the vacuum pressure from the initial vacuum pressure chosen in order to maintain a continuous flow of slurry through the cathode.

Vacuum depositing a thin base mat of synthetic fibrous material on the foraminous cathode from an aqueous slurry comprising such fibers is relatively quick and efficient, results in substantially uniform coverage of the cathode by the base mat, and avoids the overlap of material in the valleys between fingered cathode elements, as well as any joints, seams and convolutions caused by the use of a preformed material. The deposited base mat serves as an improved barrier to the passage of synthetic diaphragm solids material, e.g., the mat retains more of the solids comprising the synthetic diaphragm slurry, and thereby decreases substantially the loss of costly fibrous polymeric solids into the diaphragm slurry filtrate during formation, e.g., by vacuum deposition, of the synthetic diaphragm.

When the synthetic diaphragm is deposited on the nylon mat by a vacuum deposition process similar to that used in applying the nylon mat on the cathode, the nylon mat is typically dried before applying material comprising the synthetic diaphragm to it. Drying can be accomplished by placing the mat/cathode assembly in a furnace, e.g., a circulating air furnace, at temperatures sufficient to dry the mat, but below a temperature at which materials comprising the mat would be damaged or degraded, e.g., use of the mat for its intended purpose is impaired. Further, drying temperatures are typically less than a temperature at which decomposition by-products of surfactants used to prepare the nylon base mat slurry are formed. Drying temperatures can vary. In one non-limiting embodiment, the drying temperatures can vary between 140° F. and 160° F. (60° C. and 71° C.). If desired, a vacuum on the cathode/mat assembly can be maintained during the drying operation. Drying is typically performed over a period of time sufficient to result in substantial removal of the water contained within the nylon mat. Generally, drying is performed over a time frame that can range from 2 to 20 hours. To assist in the drying of the nylon mat, air can be pulled through the mat by attaching it to a vacuum system. Initial vacuum pressures of from 12 mm of mercury to 500 mm of mercury can be used.

Once the synthetic diaphragm has been applied on the nylon base mat, the resulting cathode/polyamide mat/synthetic diaphragm assembly can be placed in an electrolytic cell and used as the cathode. When used, for example, for the electrolysis of alkali metal halide brines, e.g., in a chlor-alkali diaphragm electrolytic cell, the nylon mat will disintegrate, e.g., erode, over time from the corrosive character of the alkaline property of the liquid catholyte. Eventually, the nylon mat will substantially disappear—leaving a cathode assembly comprising the microporous cathode and liquid-permeable synthetic diaphragm.

Synthetic diaphragms used in electrolytic cells, e.g., chlor-alkali electrolytic cells, are prepared using organic fibrous polymers. Non-limiting examples of useful organic polymers include any polymer, copolymer, graft polymer or combination thereof which is substantially chemically and mechanically resistant to the operating conditions in which the diaphragm is employed, e.g., chemically resistant to degradation by exposure to electrolytic cell chemicals, such as sodium hydroxide, chlorine and hydrochloric acid. Such polymers are typically halogen-containing polymers, e.g., fluorine-containing polymers, such as perfluorinated polymers, and chlorine-containing polymers that include fluorine.

Non-limiting examples of such halogen-containing polymers include polymers, such as polyvinyl fluoride, polyvinylidene fluoride, polytetrafluoroethylene (PTFE), polyperfluoro(ethylene-propylene), polytrifluoroethylene, polyfluoroalkoxyethylene (PFA polymer), polychlorotrifluoroethylene (PCTFE polymer) and the copolymer of chlorotrifluoroethylene and ethylene (CTFE polymer). Of the halogen-containing polymers, polytetrafluoroethylene is typically used.

In one non-limiting embodiment, the synthetic diaphragm further comprises halogenated ion-exchange materials having cation selective groups thereon, e.g., acid groups. Typical acid groups include, but are not limited to, sulfonic acid groups, carboxylic acid groups and their derivatives, e.g., esters, phosphonic acid groups, and phosphoric acid groups. Most commonly, the acid group is either a sulfonic acid groups or a carboxylic acid group.

A typical ion-exchange material that is used is a perfluorinated copolymer material prepared from the polymerization of a fluorovinyl ether monomer containing a functional group, e.g., an ion-exchange group or a functional group easily converted into an ion-exchange group, and a monomer chosen from the group of fluorovinyl compounds, such as vinyl fluoride, vinylidene fluoride, trifluoroethylene, tetrafluoroethylene, hexafluoroethylene, hexafluoropropylene, chlorotrifluoroethylene and perfluoro(alkylvinyl ether), with the alkyl being an alkyl group containing from 1 to 10 carbon atoms. A description of such ion-exchange materials can be found in column 5, line 36 through column 6, line 2 of U.S. Pat. No. 4,680,101, the disclosure of which is hereby incorporated by reference. An ion-exchange material with sulfonic acid functionality is commonly used. A perfluorosulfonic acid ion-exchange material (5 weight percent solution) is available from E. I. du Pont de Nemours and Company under the trade name NAFION. Other appropriate ion-exchange materials can be used to allow the diaphragm to be wetted by the aqueous brine fed to the electrolytic cell, as for example, the ion-exchange material available from Asahi Glass Company, Ltd. under the trade name FLEMION.

Organic polymeric materials in the form of microfibrils are also commonly used to prepare synthetic diaphragms. Such microfibrils can be prepared in accordance with the disclosure of U.S. Pat. No. 5,030,403. The fibers and microfibrils of the organic polymeric material, e.g., PTFE fibers and microfibrils, comprise the predominant portion of the diaphragm solids.

Generally, the synthetic diaphragm contains a major amount of the polymer fibers and microfibrils. As the ion-exchange material is often more costly than the polymer fibers and microfibrils, the diaphragm typically comprises from 65 to 93 percent by weight combined of the such fibers and microfibrils and from 0.5 to 2 percent by weight of the ion-exchange material.

The organic fibrous polymers of the synthetic diaphragm are typically used in particulate form, e.g., in the form of particulates or fibers, as is well known in the art. In the form of fibers, the organic polymer material generally has a fiber length of up to 0.75 inch (1.91 cm) and a diameter of from 1 to 250 microns. Polymer fibers comprising the diaphragm can be of any suitable denier, e.g., commercially available fibers. A typical PTFE fiber used to prepare synthetic diaphragms is a 0.25 inch (0.64 cm) chopped 6.6 denier fiber; however, other lengths and fibers of smaller or larger deniers can be used.

In addition to the aforedescribed fibers and microfibrils of halogen-containing polymers and perfluorinated ion-exchange materials, the formulation used to prepare the synthetic diaphragm can also include, but is not limited to, other additives, such as thickeners, surfactants, antifoaming agents, antimicrobial agents and other polymers. Such other additives are discussed previously in connection with the polyamide slurry used to deposit the nylon mat. That discussion of additives is equally applicable here in connection with the slurry used to deposit the synthetic diaphragm. In addition, materials such as fiberglass can also be incorporated into the diaphragm. A non-limiting example of the components of a synthetic diaphragm material useful in a chlor-alkali electrolytic cell can be found in Example 1 of U.S. Pat. No. 5,188,712, the disclosure of which is incorporated herein by reference.

Synthetic diaphragms can also comprise various modifiers and additives, including but not limited to, inorganic fillers, such as clays, metal oxides, pore formers, wetting agents, etc, as is well known in the art. Synthetic diaphragms can comprise one or more layers of material that are deposited on and within the portion of the diaphragm comprising the fibrous halogenated polymeric materials, e.g., a base coat of fibrous halogenated polymeric materials and one or more top coats of modifiers and additives, as is known in the art.

In accordance with a non-limiting embodiment of the method of the present invention, the components of the liquid-permeable synthetic diaphragm are deposited onto the nylon base mat from a slurry of such components. Typically, the slurry comprises an aqueous liquid medium, such as water. An aqueous slurry used to deposit the synthetic diaphragm typically comprises from 1 to 6 weight percent solids, e.g., from 1.5 to 3.5 weight percent solids, of the diaphragm components in the slurry, and has a pH of between 8 and 11. The appropriate pH can be obtained by the addition of an alkaline reagent, such as alkali metal hydroxide, e.g., sodium hydroxide, to the slurry.

The amount of each of the components comprising the synthetic diaphragm can vary in accordance with variations known to those skilled in the art. With respect to the components described in the examples of the present application, and for slurries having percent solids of between 1 and 6 weight percent, the following approximate amounts (as a percentage by weight of the total slurry) of the components in the slurry used to deposit the synthetic diaphragm can be used: polyfluorocarbon fibers, e.g., PTFE fibers,—from 0.25 to 1.5 percent; polyfluorocarbon microfibrils, e.g., PTFE microfibrils,—from 0.6 to 3.8 percent; ion-exchange material, e.g., NAFION resin,—from 0.01 to 0.05 percent; fiberglass—from 0.06 to 0.4 percent; and polyolefin, e.g., polyethylene, such as SHORT STUFF,—from 0.06 to 0.3 percent. All of the aforementioned percentages are weight percentages and are based on the total weight of the slurry.

The aqueous slurry comprising the synthetic diaphragm components can also contain a viscosity modifier or thickening agent to assist in the dispersion of the solids, e.g., the perfluorinated polymeric materials, in the slurry. For example, a thickening agent such as CELLOSIZE® materials can be used. Generally, from 0.1 to 5 percent by weight of the thickening agent can be added to the slurry mixture, basis the total weight of the slurry, more typically from 0.1 to 2 percent by weight thickening agent.

A surfactant can also be added to the aqueous slurry of the synthetic diaphragm components to assist in obtaining an appropriate dispersion. Typically, the surfactant is a nonionic surfactant and is used in amounts of from 0.1 to 3 percent, more typically from 0.1 to 1 percent, by weight, basis the total weight of the slurry. Particularly contemplated nonionic surfactants are chloride capped ethoxylated aliphatic alcohols, wherein the hydrophobic portion of the surfactant is a hydrocarbon group containing from 8 to 15, e.g., 12 to 15, carbon atoms, and the average number of ethoxylate groups ranges from 5 to 15, e.g., 9 to 10. An example of such nonionic surfactant is AVANEL® N-925 surfactant.

Other additives that can be incorporated into the aqueous slurry of the synthetic diaphragm forming components include antifoaming amounts of an antifoaming agent, such as UCON® 500 antifoaming compound, to prevent the generation of excessive foam during mixing of the slurry, and an antimicrobial agent to prevent the digestion of cellulose-based components by microbes during storage of the slurry. An appropriate antimicrobial is UCARCIDE® 250, which is available from the Dow Chemical Company. Other antimicrobial agents known to those skilled in the art also can be used. Antimicrobials can be incorporated into the slurry in amounts of from 0.05 to 0.5 percent by weight, e.g., between 0.08 and 0.2 weight percent.

The synthetic diaphragm can be deposited from a slurry, e.g., an aqueous slurry, of synthetic diaphragm components directly upon the nylon base mat (or upon a layer of another material placed on the nylon base mat) by vacuum deposition, pressure deposition, combinations of such deposition techniques or other techniques known to those skilled in the art. The foraminous cathode/nylon base mat assembly is immersed into the slurry comprising the synthetic diaphragm components, which has been well agitated to insure a substantially uniform dispersion of such components, and the slurry drawn through the liquid-permeable nylon base mat, thereby to deposit the components of the synthetic diaphragm onto the nylon base mat.

Typically, the slurry is drawn through the cathode/nylon base mat assembly with the aid of a vacuum pump. It is customary to increase the vacuum as the thickness of the diaphragm layer deposited increases, e.g., to a final vacuum of 15 inches (381 mm) or 20 inches (508 mm) of mercury. The cathode/nylon mat/synthetic diaphragm assembly is withdrawn from the slurry, usually with the vacuum still applied to insure adhesion of the diaphragm to the nylon base mat and to assist in the removal of excess liquid from the diaphragm. The weight density of the synthetic diaphragm can vary, but typically is between 0.25 and 0.55 pounds per square foot (1.22-2.68 kg/square meter), e.g., from 0.3 to 0.6 pounds per square foot (1.5 to 2.9 kilograms per square meter), such as 0.35 pounds per square foot (1.71 kg/square meter, of the polyamide base mat. In alternate non-limiting embodiments, the weight density of the synthetic diaphragm can vary from between 0.28 and 0.45 pounds per square foot (1.37-2.2 kg/square meter), e.g., between 0.42 and 0.44 pounds per square foot (2.05-2.15 kg/square meter) of the polyamide base mat. The thickness of the synthetic diaphragm can vary, but in one non-limiting embodiment will generally vary between 0.075 and 0.25 inches (0.19-0.64 cm), e.g., between 0.1 and 0.15 inches (0.25-0.38 cm).

In a non-limiting embodiment of the present invention, after removal of excess liquid present in the synthetic diaphragm, and while the diaphragm is still wet, e.g., the diaphragm is not permitted to dry completely, inorganic particulate material is deposited on and within the exposed face of the diaphragm; namely, the face that will be next to the anolyte chamber.

In an alternate embodiment of the method of the present invention, the synthetic diaphragm is dried prior to deposition of the inorganic particulate material, as previously described. This additional drying step further improves the surface uniformity of the inorganic material deposited on and within the synthetic diaphragm. While not intending to be bound by any theory, it believed that this drying step increases the pore size of the synthetic diaphragm and allows the inorganic material to penetrate deeper and lay down more uniformly upon the synthetic diaphragm.

The additional drying step can be conducted at a temperature less than that of the sintering or melting temperature of the synthetic polymeric material of the synthetic diaphragm. However, the liquid slurry from which the synthetic diaphragm is formed often further comprises a surfactant, e.g., a non-ionic surfactant. As such, the temperature of the additional drying step is more typically less than the temperature at which decomposition by-products of the surfactant are formed. The temperature of the additional drying step can range between any combination of the temperatures previously mentioned The synthetic diaphragm is liquid-permeable, thereby allowing an electrolyte, such as sodium chloride brine, subjected to a pressure gradient to pass through the diaphragm. Typically, the pressure gradient in a diaphragm electrolytic cell is the result of a hydrostatic head on the anolyte side of the cell, e.g., the liquid level in the anolyte compartment will be on the order of from 1 to 25 inches (2.54-63.5 cm) higher than the liquid level of the catholyte compartment. The specific flow rate of electrolyte through the diaphragm can vary with the type of the cell, and how it is used. In a chlor-alkali cell, the diaphragm should be able to pass from 0.001 to 0.5 cubic centimeters of anolyte per minute per square centimeter of diaphragm surface area. The flow rate is generally set at a rate that allows production of a predetermined, targeted alkali metal hydroxide concentration, e.g., sodium hydroxide concentration, in the catholyte, and the level differential between the anolyte and catholyte compartments is then related to the porosity of the diaphragm and the tortuosity of the pores. For use in a chlor-alkali cell, the synthetic diaphragm will typically have a porosity (permeability) similar to that of asbestos-type and polymer modified asbestos diaphragms.

As mentioned, it is common to apply (usually by vacuum deposition) a coating of water-insoluble, inorganic particulate material on top of and within the interstices of the synthetic diaphragm. Details of such coatings and the methods used to form such coatings can be found in U.S. Pat. Nos. 5,612,089, 5,683,749 and 6,299,939 B1.

As discussed in column 2, line 65 through column 4, line 50 of U.S. Pat. No. 6,299,939, which disclosure is incorporated by reference, the water-insoluble inorganic particulate material in the topcoat can be selected from (i) oxides, borides, carbides, silicates and nitrides of valve metals, (ii) clay minerals, and (iii) mixtures of (i) and (ii). As used herein, the term "valve metal" includes vanadium, chromium, zirconium, niobium, molybdenum, hafnium, tantalum, titanium, tungsten and mixtures of such metals. Of the aforementioned valve metals, titanium and zirconium are typically used. Of the valve metal oxides and valve metal silicates, valve metal oxides are typically used, e.g., titanium dioxide and zirconium oxide.

Clay minerals that can be used in the topcoat include those that are naturally occurring hydrated silicates of metals, such as aluminum and magnesium e.g., kaolin, meerschaums, augite, talc, vermiculite, wollastonite, montmorillonite, illite, glauconite, attapulgite, sepiolite and hectorite. Of the clay minerals, attapulgite, hectorite, montmorillonite, sepiolite and mixtures of such clay minerals are typically used. Hydrated magnesium silicates and magnesium aluminum silicates can be found naturally, but can also be prepared synthetically.

The mean particle size of the water-insoluble inorganic particulate material can vary, but is typically in the range of from 0.1 microns to 20 microns, e.g., from 0.1 micron to 0.5 microns. An attapulgite clay product having a mean particle size of about 0.1 microns is available from Engelhard Corporation under the trade name, ATTAGEL®.

A method that can be used to deposit the topcoat of inorganic particulates on the synthetic diaphragm is vacuum deposition; namely, the same method used to deposit the nylon base mat onto the cathode, and the synthetic diaphragm onto the nylon base mat. The components comprising the topcoat are slurried in a liquid medium, e.g., water, and then vacuum deposited on the synthetic diaphragm. The amount of water-insoluble inorganic particulate material present in liquid medium, e.g., the aqueous slurry, can vary widely and will depend on, for example, how much inorganic material is desired to be deposited on and within the synthetic diaphragm. Typically, the topcoat slurry will contain from 1 to 15 grams per liter of aqueous medium (gpl), e.g., from 5 to 10 gpl.

The topcoat slurry can also contain alkali metal polyphosphates, e.g., sodium and potassium polyphosphates. As used herein, the term "alkali metal polyphosphates" includes dehydrated alkali metal polyphosphates, hydrated alkali metal polyphosphates and mixtures of such polyphosphates. Classes of alkali metal polyphosphates include, but are not limited to, tetraalkali metal pyrophosphate, e.g., tetrasodium pyrophosphate, alkali metal triphosphate, e.g., sodium triphosphate, alkali metal tetraphosphate, e.g., sodium tetraphosphate, alkali metal hexametaphosphate, e.g., sodium hexametaphosphate, and mixtures of such polyphosphates. The amount of alkali metal polyphosphate in the topcoat slurry can vary from 0.01 to 2 percent by weight, typically from 0.05 to 0.5 percent, e.g., from 0.1 to 0.5 percent, by weight, based on the total weight of the liquid topcoat slurry. The weight ratio of water-insoluble inorganic particulate material to alkali metal polyphosphate in the topcoat slurry is typically from 0.5:1 to 300:1, e.g., from 1:1 to 20:1, more typically 10:1.

The aqueous topcoat slurry can contain alkali metal halide, e.g., sodium chloride, and/or alkali metal hydroxide, e.g., sodium hydroxide, in amounts totaling from 0.01 to 10 percent by weight, based on the total weight of the liquid medium, e.g., the aqueous medium. Typically, the aqueous medium is substantially free of the alkali metal halide and the alkali metal hydroxide; namely, there is less than 1 weight percent combined of said alkali metal halide and alkali metal hydroxide in the topcoat slurry.

The topcoat slurry can also contain an organic surfactant chosen from nonionic, anionic and amphoteric surfactants, and mixtures of such surfactants in amounts sufficient to wet the synthetic diaphragm during deposition of the materials comprising the topcoat. The organic surfactant is typically present in amounts of from 0.01 to 1 weight percent, e.g., from 0.05 to 0.3 weight percent, based on the total weight of the liquid medium, e.g., water, comprising the topcoat slurry. Organic surfactants that can be used in the topcoat slurry are enumerated in column 4, line 65 to column 6, line 55 of the aforementioned '939 patent, which disclosure is incorporated herein by reference.

The cathode/nylon mat/synthetic diaphragm assembly can be immersed in the topcoat slurry and the topcoat slurry drawn through the assembly by methods known to those skilled in the art, for example, under vacuum. The density of water-insoluble inorganic material deposited on and within the synthetic diaphragm is typically from 0.01 to 0.1 pounds per square foot (0.05 to 0.5 kg/square meter), e.g., 0.05 pounds per square foot (0.25 kg/square meter). The deposited topcoat can be dried, if desired, by the same methods, temperatures and times used to dry the nylon mat and synthetic diaphragm. Drying is performed under conditions sufficient to result in substantial removal of excess water from the topcoat, and to allow the entire cathode assembly to be physically handled without loss or damage to any of the layers comprising such assembly. e.g., the nylon base mat, synthetic diaphragm and topcoat.

The cathode assembly of the present invention, e.g., an assembly comprising a foraminous metallic cathode/nylon base mat/synthetic diaphragm (with or without further topcoat layers atop the synthetic diaphragm, as described herein) can be used in electrolytic cells (as defined earlier) for the electrolysis of ionizable compounds such as aqueous solutions of inorganic salts, particularly electrolytic cells for the electrolysis of alkali metal salts, e.g., alkali metal aqueous brines such as sodium chloride and potassium chloride brines.

The present invention is more particularly described in the following examples, which are intended to be illustrative only, since numerous modifications and variations therein will be apparent to those skilled in the art.

In the following examples, all reported percentages are weight percents, unless noted otherwise or unless indicated as otherwise from the context of their use. The efficiencies of the laboratory chlor-alkali electrolytic cells are "caustic efficiencies," which are calculated by comparing the amount of sodium hydroxide collected over a given time period with the theoretical amount of sodium hydroxide that would be generated applying Faraday's Law. The reported weight density of the various layers comprising the diaphragm is based upon the dry weight of the layer per unit area.

The diaphragms described in the following examples are by design generally too permeable to operate with a normal sodium chloride brine feed rate, e.g., they are too permeable to maintain a normal level of liquid in the cell during cell start-up and at times during cell operation. Therefore, materials, e.g., magnesium hydroxide, ATTAGEL® 17, 20, 36 or 50 attapulgite clay and mixtures of such materials, are added to the anolyte compartment of the cell at start-up and during cell operation in response to the cell's performance to adjust the permeability of the diaphragm so that it will operate at the desired liquid level and other operating parameters, such as low hydrogen levels in the chlorine gas. The addition of such materials during cell operation is commonly referred to as doping the cell.

Dopant materials are added to the anolyte compartment of the cell mixed with sodium chloride brine, usually 100 ml of such brine, which is about a 24.5 percent aqueous sodium chloride solution. Further, an acid, e.g., hydrochloric acid, can also be added to the doping solution to reduce its pH to from 0.3 to 2.0 before adding the doping solution to the anolyte compartment.

EXAMPLE 1

To a 4 liter Nalgene polyethylene beaker was added 2964.7 grams of deionized water. The beaker was fitted with a laboratory Greerco M/N IL mixer connected to an autotransformer. The mixer was placed in the water and mixing initiated at 70% output at 120 volts AC. CELLOSIZE® ER-52 hydroxyethyl cellulose (18.6 grams) was added to the water over a period of approximately 1 minute. A 1 Normal sodium hydroxide solution (8.8 grams) was then added to the mixture. After mixing for approximately 1 minute, 3.0 grams of AVANEL® N 925 (90%) nonionic surfactant was added to the mixture and mixing continued for approximately 3 minutes. 7.5 grams of nylon fibers (MiniFibers, Johnston City, Tenn.) of a size 15 Denier by 3 mm were then added slowly to the mixture over a period of approximately 2 minutes by adding the fibers to the liquid vortex. Mixing was continued for an additional 2 minutes before stopping the agitator. The resulting slurry was transferred to a storage container. The nylon slurry had a viscosity (Brookfield #2 spindle) of 520 centipoises and a pH of 11.23.

A laboratory cathode prepared with mild steel mesh [3.625 inches×3.625 inches (9.2 cm×9.2 cm) screen area], approximately 0.125 inch (0.32 cm) thick with nominal 0.075 inch (0.2 cm) openings was clamped to a polymethylpentene depositing apparatus, which was connected to a liquid trap and water aspirator vacuum source, and placed in a rectangular depositing tank 5.125 inches wide, 2.75 inches deep and 13 inches high (13 cm×7 cm×33 cm).

The nylon slurry described above was air sparged for 30 minutes by placing a dip tube attached to a source of compressed air into the storage container holding the slurry. During air sparging, some foaming occurred, which was controlled by the addition of 0.2 grams of UCON® LO-500 defoamer to the slurry. The nylon slurry was transferred to the depositing tank, and after the void between the cathode and the depositing apparatus filled with nylon slurry, the vacuum source connected to the depositing apparatus was initiated. Nylon fibers were deposited onto the cathode screen over a period of approximately 2 minutes with a maximum vacuum of 11 inches (279 mm) of mercury to form a nylon mat on the cathode screen. The cathode was removed from the nylon slurry after the required nylon slurry filtrate volume was obtained in the liquid trap. Full vacuum was maintained on the cathode assembly for an additional 10 minutes to completely dewater the deposited nylon mat. The vacuum was broken and the cathode assembly (including the depositing apparatus) placed in a circulating air oven maintained at 140° F.-160° F. (60° C.-71° C.) overnight to dry. After drying was completed, the cathode was removed from the depositing apparatus and weighed, with the basis weight of the deposited nylon mat obtained by difference. The basis weight was calculated to be 4.98 oz/yard$^2$ (0.17 kg/m$^2$).

A synthetic diaphragm slurry was prepared by the following method. To a 4 liter Nalgene polyethylene beaker equipped with a Greerco M/N IL mixer (connected to a 120 volt autotransformer) was added 2630.8 grams of deionized water. Mixing was initiated at an autotransformer setting of 70%. CELLOSIZE® ER-52M (16.8 grams) was added to the water immediately after stirring was initiated and allowed to mix for 1 minute. A 1 Normal sodium hydroxide solution (9.9 grams) was added to the mixture. After 3 minutes of additional mixing, 30.3 grams of AVANEL® N-925 (90%) nonionic surfactant in water was added to the mixture and allowed to mix for 1 minute. UCARCIDE® 250 biocide (3.2 grams) was then added to the mixture and mixing was continued for 2 minutes. A thoroughly mixed slurry of 8 weight percent polytetrafluoroethylene (PTFE) fibers (871.5 grams) having an average size of 718 microns (equivalent diameter of a sphere that encompasses the fiber, as measured by a Coulter LS particle size analyzer) was added to the plastic beaker with continued stirring. TEFLON® floc (Detex 24, 32.8 grams) was added slowly to the stirring slurry over a period of approximately 3-4 minutes, followed by the addition of 7.4 grams of Short Stuff E-400F polyethylene fiber. After an additional 1¼ minutes mixing, 22.7 grams of NAFION® SE-5112 perfluorosulfonic acid solution was added to the slurry. The resulting slurry was mixed for an additional 11 minutes. The final slurry contained 3.5 percent solids, and had a pH of 10.35 and a final temperature of 100° F. (38° C.).

The above-described synthetic diaphragm slurry was air sparged for 30 minutes by placing a dip tube attached to a source of compressed air into the storage container holding the slurry to thoroughly mix the slurry. After mixing, the slurry was transferred to a vertical deposition tank. The foraminous cathode/nylon mat assembly, which was attached to a depositing block that was connected to a liquid trap and water aspirator source, was placed within the slurry. After the space between the cathode and the depositing block filled with the slurry, vacuum was applied to the depositing block, thereby causing the slurry to be drawn through the nylon mat and the cathode and resulting in the deposition of a synthetic diaphragm on the nylon mat. Vacuum was controlled to regulate the rate of deposition. Periodic agitation of the slurry within the tank was used to assure a consistent slurry concentration. When the desired thickness of synthetic diaphragm was deposited (after approximately 15 minutes), the cathode assembly was removed from the slurry and allowed to dewater with full vacuum flow [21.5 inches of mercury] (546 mm of mercury) for a period of 27 minutes. The cathode/nylon mat/synthetic diaphragm assembly was placed in a 140° F. (60° C.) oven for 4 hours with a vacuum applied to the cathode to enhance drying.

The synthetic diaphragm had a calculated basis weight of 0.31 pounds/ft$^2$ (1.5 kg/m$^2$). The amount of the synthetic diaphragm that was retained on the cathode/nylon mat assembly was calculated to be 81.7%. Consequently, approximately 19.3% of the synthetic diaphragm slurry passed through the cathode and was accumulated as slurry filtrate. The basis weight of the synthetic diaphragm is the calculated dry weight of the synthetic diaphragm divided by the active area of the steel mesh (screen area) portion of the cathode.

A topcoat for the synthetic diaphragm was prepared and applied to the synthetic diaphragm as follows. A topcoat slurry was prepared using a 4 liter Nalgene polyethylene beaker. A Caframo M/N RZR-1 mixer equipped with a 10 inch TEFLON® coated shaft and collapsible paddle operated at 650 rpm was used to mix the slurry. The topcoat slurry was prepared by dispersing 18.09 grams of ZIROX® 120 zirconium oxide powder (mass based median equivalent spherical diameter of approximately 1.75 microns) and 11.98 grams of ATTAGEL® 50 attapulgite clay powder into 3000.1 grams of deionized water containing 3.03 grams (1 gram/liter) of tetrasodium polyphosphate decahydrate. After mixing for 10 minutes, 3.03 grams of AVANEL® N-925 (90%) nonionic surfactant was added to the mixture followed by an additional 3 minutes of mixing. The topcoat slurry contained approximately 60% of the zirconium oxide powder and 40% of the attapulgite clay powder, basis the total weight of the solids in the topcoat slurry.

The topcoat slurry was mixed for 10-30 minutes using the Cafcamo M/N RZR-1 mixer and then transferred to a vertical deposition tank of the type previously described. The cathode assembly (cathode/nylon mat/synthetic diaphragm) was attached to a depositing block (as previously described), placed in the deposition tank and vacuum applied to the depositing block, thereby causing the topcoat solution to be drawn through the synthetic diaphragm and depositing a topcoat on the surface of the synthetic diaphragm. Topcoating was allowed to continue without controlling the vacuum for 20 minutes. Periodic agitation of the slurry within the tank was used to keep the slurry well mixed. After 20 minutes, the cathode assembly (now including a topcoat layer) was removed from the slurry and allowed to dewater with full vacuum flow applied for a period of 5 minutes. The cathode assembly was placed in a 140° F. (60° C.) oven for 5 hours with a vacuum applied to the cathode to enhance drying.

The topcoat had a calculated basis weight of 0.019 pounds/ft$^2$ (0.09 kg/m$^2$). The basis weight of the topcoat is the calculated dry weight of the topcoat divided by the active area of the steel mesh (screen area) portion of the cathode. The thickness of the diaphragm (nylon mat/synthetic diaphragm/topcoat) was after drying calculated to be 0.17 inches (0.4 cm).

The resulting diaphragm and cathode assembly were placed in a laboratory chlor-alkali electrolytic cell to measure its performance. The anode used was a ruthenium oxide coated flattened expanded titanium mesh [0.04 inches] (0.1 cm) thick with 1/16 inch×3/16 inch (0.16 cm×0.48 cm) openings. The anode and cathode screen each had an active area of 3 inches×3 inches (7.6 cm×7.6 cm). The cell had an electrode spacing of 3/16 inch (0.48 cm) and was flushed with deionized water overnight prior to operation. After completing the overnight water flushing, the cell was drained and filled with sodium chloride brine having a concentration of approximately 305 grams/liter. The cell was then operated at a temperature of 196° F. (91° C.) and a current setting of 9.0 amperes [144 amperes/square foot (ASF) current density]. At cell start up, sodium chloride brine having a pH of 5.5 was fed to cell at a rate of 2.2-2.4 ml/minute.

The cell was operated for 89 days and was doped 10 times using a doping slurry prepared by adding 0.10 gram of ATTAGEL® 50 attapulgite clay powder and 0.07 grams of magnesium hydroxide to 100 ml of the sodium chloride brine (pH adjusted to a value of 1 to bring the anolyte to a pH of 1-2). The cell operated at 2.82 volts with a caustic efficiency of 96% for a power consumption of 2012 DC kilowatt hours/ton of chlorine produced. The concentration of sodium hydroxide produced by the cell was 113 grams/liter. All performance values are corrected to a brine depletion (the amount of brine consumed in the electrolysis) of 50%.

EXAMPLE 2

The procedure of Example 1 was repeated on a second cathode screen of the same dimensions. The basis weight of the nylon mat was 4.94 oz/yd$^2$ (0.17 kg/m$^2$). The synthetic diaphragm had a basis weight of 0.337 pounds/ft$^2$ 1.6 kg/m$^2$. The amount of synthetic diaphragm retained on the cathode assembly was calculated to be 81.3%. Consequently, approximately 19.7% of the synthetic diaphragm slurry passed through the cathode and was accumulated as slurry filtrate. The synthetic diaphragm had a calculated thickness after drying of 0.19 inches (0.5 cm). The basis weight of the topcoat was 0.0304 pounds/ft$^2$ (0.15 kg/m$^2$). The diaphragm thickness (nylon mat/synthetic diaphragm/topcoat) after drying was calculated to be 0.17 inches (0.4 cm).

The cathode/nylon mat/synthetic diaphragm/topcoat assembly was placed in a laboratory electrolytic cell, as described in Example 1 and operated in the manner and the conditions described in Example 1 for 89 days. The cell was doped 10 times, as described in Example 1. The cell operated at 2.86 volts with a caustic efficiency of 95.8% for a power consumption of 2039 DC kilowatt hours/ton of chlorine produced. The concentration of sodium hydroxide produced by the cell was 114 grams/liter. All performance values are corrected to a brine depletion (the amount of brine consumed in the electrolysis) of 50%.

EXAMPLE 3 (COMPARATIVE)

The procedure of Example 1 was repeated except that a preformed nylon net was mechanically applied to the cathode screen instead of vacuum depositing a nylon mat onto the screen. The preformed nylon net was applied in the following manner. A shield was made to cover the active cathode screen area of the cathode and placed over the screen. The periphery of the cathode was sprayed with 3M Super-77 adhesive. One piece of nylon net (Apex Mills ALTO nylon) was cut to cover the cathode screen and the periphery of the cathode. The shield was removed and the nylon net placed on the cathode, taking care to apply the nylon net in a smooth, wrinkle-free manner. The nylon net was bound to the cathode around the entire periphery of the cathode. The synthetic diaphragm and topcoat (as described in Example 1) were applied to the cathode in the manner described in Example 1. The basis weight of the nylon net was 0.28 oz/yd$^2$ (0.9 kg/m$^2$). The synthetic diaphragm basis weight was 0.28 pounds/square foot (1.4 kg/m$^2$). The amount of the synthetic diaphragm that was retained on the nylon net of the cathode assembly was calculated to be 73.2%. Consequently, approximately 26.8% of the synthetic diaphragm solids slurry passed through the cathode and was accumulated as slurry filtrate. The topcoat basis weight was 0.023 pounds/square foot (0.11 kg/m$^2$), and the diaphragm thickness (nylon mat/synthetic diaphragm/topcoat) after drying was calculated to be 0.117 inches (0.3 cm).

The cathode assembly (cathode/preformed nylon net/synthetic diaphragm/topcoat) was placed in a laboratory chlor-alkali cell following the procedure of Example 1 and the cell operated in the manner and conditions described in Example 1 for 89 days. The cell was doped 10 times, as described in Example 1.

The cell operated at 2.86 volts with a caustic efficiency of 94.9% for a power consumption of 2058 DC kilowatt hours/ton of chlorine produced. The concentration of sodium hydroxide produced by the cell was 113 grams/liter. All performance values are corrected to a brine depletion (the amount of brine consumed in the electrolysis) of 50%.

The data of Example 3 shows that use of a preformed nylon net on the cathode screen (compared to a vacuum deposited nylon mat) results in a lower synthetic diaphragm basis weight (0.28 vs. 0.31 and 0.37 pounds/square foot) [1.4 vs. 1.5 and 1.6 kg/m$^2$), and a lower amount of synthetic diaphragm deposited on the nylon layer placed on the cathode screen (73.2% vs. 81.7 and 81.3%). Moreover, the cell operating efficiency of the cell using the preformed nylon net was significantly lower (94.9%) than the operating efficiency of the cell using the vacuum deposited nylon mat (95.8 and 96.0), although the cell voltages were approximately the same, e.g., 2.86 vs. 2.82 and 2.86 volts. Thus, use of the vacuum deposited nylon mat results in less loss of synthetic diaphragm slurry and a higher cell operating efficiency, both of which are significant economic benefits. Finally, although the method that uses a performed nylon net uses less nylon (basis weight), the extra material cost for the nylon is far offset by the significant reduction in labor costs for fabricating and applying the nylon net to the cathode screens, particularly when the cathode is a fingered cathode electrode.

The present invention has been described with reference to specific details of particular embodiments thereof. It is not intended that such details be regarded as limitations upon the scope of the invention except insofar as and to the extent that they are included in the accompanying claims.

What is claimed is:

1. A cathode assembly for an electrolytic cell comprising a foraminous cathode substrate, a deposited liquid-permeable erodible mat comprising synthetic fibers on a surface of said cathode substrate, and a synthetic diaphragm on said synthetic fiber-containing erodible mat.

2. The cathode assembly of claim 1 wherein the synthetic fibers are chosen from aliphatic polyamide fibers, aromatic polyamide fibers, rayon fibers, acetate fibers, triacetate fibers, acrylic fibers, polyolefin fibers, polyester fibers, polyphenylene sulfide fibers, and mixtures of said fibers.

3. The cathode assembly of claim 2 wherein the aliphatic polyamide fibers are chosen from nylon 6, nylon 6-6, nylon 11, nylon 6-10 and mixtures of said nylon fibers; the aromatic polyamide fibers are chosen from the polyamides prepared from isophthalic acid and m-phenylene diamine; the acrylic fibers are chosen from fibers prepared from polyacrylonitrile; the polyolefin fibers are chosen from polyethylene fibers, polypropylene fibers and mixtures of said polyolefin fibers; and the polyester fibers are chosen from fibers prepared from ethylene glycol and dimethyl terephthalate or terephthalic acid.

4. The cathode assembly of claim 1 wherein the liquid-permeable erodible synthetic mat is superimposed on the electrolytically active surface of the cathode substrate, and the synthetic diaphragm is appended to the liquid-permeable erodible synthetic mat.

5. The cathode assembly of claim 1 wherein the electrolytic cell is a chlor-alkali electrolytic cell.

6. The cathode assembly of claim 5 wherein the synthetic fibers of the liquid-permeable erodible mat are chosen from aliphatic polyamide fibers, aromatic polyamide fibers and mixtures of said polyamide fibers.

7. The cathode assembly of claim 6 wherein the synthetic diaphragm is substantially free of asbestos, and the synthetic diaphragm has applied to it a top coat of water-insoluble, inorganic particulate material.

8. A cathode assembly for a chlor-alkali electrolytic cell comprising a foraminous metallic cathode substrate, a vacuum deposited liquid-permeable erodible mat comprising aliphatic polyamide fibers appended to an electrolytically active portion of the foraminous surface of said cathode substrate, and a synthetic non-asbestos-containing diaphragm appended to said mat.

9. The cathode assembly of claim 8 wherein the erodible mat has a thickness of from 0.1 to 3.3 millimeters.

10. The cathode assembly of claim 8 wherein the chlor-alkali electrolytic cell is an electrolytic cell for the electrolysis of aqueous solutions of sodium chloride.

11. The cathode assembly of claim 10 wherein the aliphatic polyamide fibers are chosen from nylon 6, nylon 6-6, nylon 6-10, nylon 11, and mixtures of said nylon fibers.

12. The cathode assembly of claim 11 wherein the aliphatic polyamide fibers have a length of from 1 to 12.7 millimeters and a denier of from 1 to 50.

13. The cathode assembly of claim 12 wherein the aliphatic polyamide fibers have a length of from 3 to 6.5 millimeters and a denier of from 10 to 20, and the erodible mat has a thickness of from 0.14 to 1.2 millimeters.

14. A method of preparing a cathode assembly for use in an electrolytic cell comprising:

(a) depositing a mat comprising synthetic erodible fibers on the surface of a foraminous cathode, thereby to form a liquid-permeable mat on the foraminous cathode, and (b) forming a synthetic diaphragm on said mat.

15. The method of claim 14 wherein the synthetic erodible fibers are chosen from aliphatic polyamide fibers, aromatic polyamide fibers, rayon fibers, acetate fibers, triacetate fibers, acrylic fibers, polyolefin fibers, polyester fibers and polyphenylene sulfide fibers.

16. The method of claim 15 wherein the aliphatic polyamide fibers are chosen from nylon 6, nylon 6-6, nylon 11, nylon 6-10 and mixtures of said nylon fibers; the aromatic polyamide fibers are chosen from the polyamides prepared from isophthalic acid and m-phenylene diamine; the acrylic fibers are chosen from fibers prepared from polyacrylonitrile; the polyolefin fibers are chosen from polyethylene fibers, polypropylene fibers and mixtures of said polyolefin fibers; and the polyester fibers are chosen from fibers prepared from ethylene glycol and dimethyl terephthalate or terephthalic acid.

17. The method of claim 14 wherein the electrolytic cell is a chlor-alkali electrolytic cell.

18. The method of claim 17 wherein the synthetic fibers of the liquid-permeable erodible mat are chosen from aliphatic polyamide fibers and aromatic polyamide fibers, and the synthetic diaphragm is substantially free of asbestos.

19. The method of claim 18 wherein the chlor-alkali electrolytic cell is an electrolytic cell for the electrolysis of aqueous solutions of sodium chloride, and the aliphatic polyamide fibers are chosen from nylon 6, nylon 6-6, nylon 6-10, nylon 11, and mixtures of said nylon fibers.

20. The method of claim 19 wherein the aliphatic polyamide fibers have a length of from 3 to 6.5 millimeters and a denier of from 10 to 20, and the slurry has a viscosity of from 500 to 800 centipoises, said slurry containing from 0.1 to 3 percent by weight of the aliphatic polyamide fibers.

21. A method of preparing a cathode assembly for use in a chlor-alkali electrolytic cell comprising:

(a) depositing a liquid-permeable mat comprising synthetic erodible fibers on an electrolytically active surface of a foraminous metallic cathode, said mat having a thickness of from 0.1 to 3.3 millimeters, and (b) appending a synthetic diaphragm to said erodible mat.

22. The method of claim 21 wherein the synthetic erodible fibers are chosen from aliphatic polyamide fibers, aromatic polyamide fibers, rayon fibers, acetate fibers, triacetate fibers, acrylic fibers, polyolefin fibers, polyester fibers and polyphenylene sulfide fibers.

23. The method of claim 22 wherein the electrolytic cell is an electrolytic cell for the electrolysis of aqueous solutions of sodium chloride, and the aliphatic polyamide fibers are chosen from nylon 6, nylon 6-6, nylon 11, nylon 6-10 and mixtures of said nylon fibers; the aromatic polyamide fibers are chosen from the polyamides prepared from isophthalic acid and m-phenylene diamine; the acrylic fibers are chosen from fibers prepared from polyacrylonitrile; the polyolefin fibers are chosen from polyethylene fibers, polypropylene fibers and mixtures of said polyolefin fibers; and the polyester fibers are chosen from fibers prepared from ethylene glycol and dimethyl terephthalate or terephthalic acid.

24. The method of claim 23 wherein the aliphatic polyamide fibers have a length of from 1 to 12.7 millimeters and denier of from 1 to 50.

* * * * *